United States Patent [19]

Schleupen et al.

[11] Patent Number: 4,918,389

[45] Date of Patent: Apr. 17, 1990

[54] DETECTING MISFIRING IN SPARK IGNITION ENGINES

[75] Inventors: Richard Schleupen, Grossingersheim; Christian Zimmermann, Ingersheim; Arnd-Matthias Langner, Kornwestheim, all of Fed. Rep. of Germany

[73] Assignee: Robert Bosch GmbH, Stuttgart, Fed. Rep. of Germany

[21] Appl. No.: 239,797

[22] Filed: Sep. 1, 1988

[30] Foreign Application Priority Data

Jun. 3, 1988 [DE] Fed. Rep. of Germany ..... 88108869

[51] Int. Cl.[4] ..... F02P 17/00

[52] U.S. Cl. ..... 324/399; 324/388

[58] Field of Search ..... 324/390, 393, 399, 388, 324/402; 361/253

[56] References Cited

U.S. PATENT DOCUMENTS

| | | | |
|---|---|---|---|
| 3,942,102 | 3/1976 | Kuhn et al. | 324/399 |
| 3,961,240 | 6/1976 | Pohl | 324/399 |
| 4,053,823 | 10/1977 | Adamian | 324/399 |
| 4,163,192 | 7/1979 | Sutphin, Jr. | 324/388 |
| 4,277,752 | 7/1981 | Dinkelacker et al. | 324/399 |
| 4,280,166 | 7/1981 | Jesse et al. | 361/253 |
| 4,349,782 | 9/1982 | Doss | 324/390 |
| 4,454,560 | 6/1984 | Nakao et al. | 361/257 |
| 4,547,734 | 10/1985 | Spaude | 324/399 |
| 4,661,778 | 4/1987 | Anderson et al. | 324/380 |

FOREIGN PATENT DOCUMENTS

| | | | |
|---|---|---|---|
| 20069 | 12/1980 | European Pat. Off. | 324/388 |
| DE3629824 | 3/1988 | Fed. Rep. of Germany . | |

OTHER PUBLICATIONS

Patent Abstracts of Japan, vol. 9, No. 139 (M-387), Jun. 14, 1985, summarizing JP-A-60-19962 Yamamoto, assigned to Nippon Denso K.K.

European Search Report on EP 88 10 8869, issued Jan. 17, 1989, at The Hague, Examiner Leroy C. P.

*Primary Examiner*—Reinhard J. Eisenzopf

*Assistant Examiner*—Maura K. Regan

*Attorney, Agent, or Firm*—Frishauf, Holtz, Goodman & Woodward

[57] ABSTRACT

Misfiring in internal combustion engines is detected by detecting the voltage induced in the primary winding of the ignition coil, and comparing it to a reference voltage which represents normal firing. The reference voltage preferably has a predetermined magnitude and a predetermined duration and the detected and reference voltage are compared so as to detect when the magnitude of the detected voltage falls below the predetermined magnitude before the end of the duration.

12 Claims, 3 Drawing Sheets

DETECTING MISFIRING IN SPARK IGNITION ENGINES

This invention relates to the detection of misfiring in spark ignition engines. In engines provided with catalytic converters it is particularly desirable to detect misfiring (for example due to worn spark plugs, defective ignition cable or the like) as soon as it begins to occur because it can lead to overheating or ruining of the catalyst due to the presence of unburnt fuel in the exhaust from the engine.

BACKGROUND

Previously the temperature of the catalyst itself has been used as an indication of misfiring. This means that the catalyst has alreadY begun to overheat before misfiring is detected. It would therefore be preferable to detect misfiring before the catalyst overheats.

THE INVENTION

According to the present invention misfiring is detected from the voltage characteristic induced in the ignition coil when a spark occurs. When an ignition system is operating normallY after sparking the secondary voltage is maintained at a certain level for a certain length of time until the ignition spark breaks down. When the system misfires the secondary and consequently the primary voltage may decay immediately from an initially high voltage or the spark may break down very quickly. Thus the shape of the voltage characteristic can be used to detect misfiring.

The present invention provides a method and system of detecting misfiring in an internal combustion engine comprising detecting a signal indicative of the voltage induced in the primary winding of the ignition coil, generating a reference voltage representing normal firing and comparing the detected voltage with the reference voltage.

Preferably, the reference voltage is a pulse having a predetermined magnitude and a predetermined duration and the detected voltage is compared to the reference voltage so as to detect when the magnitude of the detected voltage falls below said predetermined magnitude before the end of the duration.

DRAWINGS

An embodiment of the invention will now be described by way of example onlY and with reference to the accompanying drawings in which.

DETAILED DESCRIPTION

Figure 1:
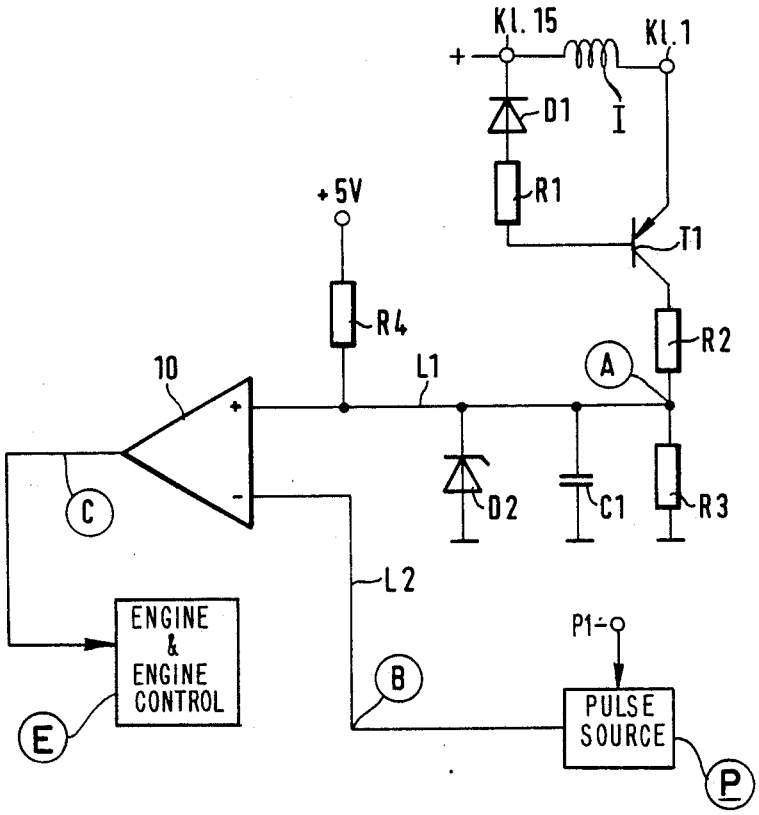
FIG. 1 is a diagram showing the circuit components used in/the present invention.
Figure 2A:
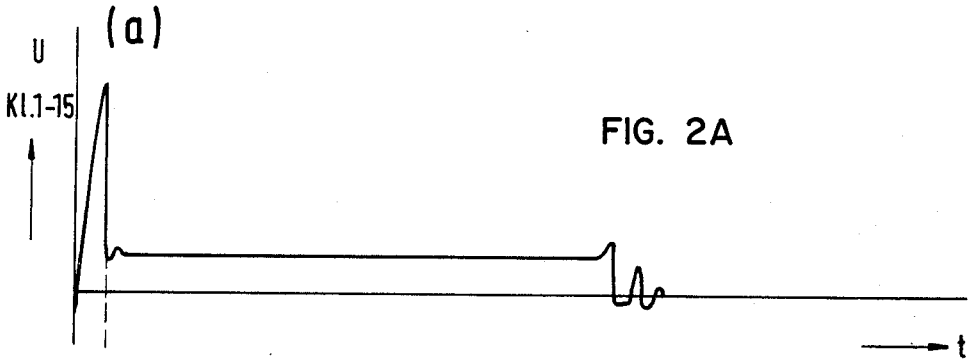
FIG. 2A–2D show the voltage versus time at various points in the circuit of FIG. 1 during normal engine operation.
Figure 2B:
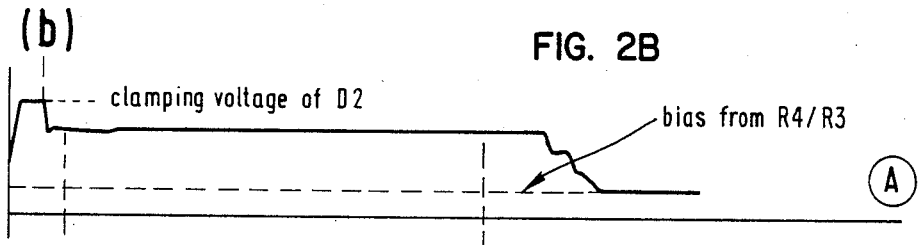
Figure 2C:
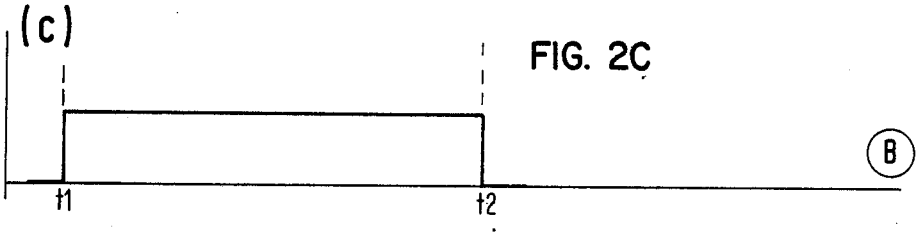
Figure 2D:
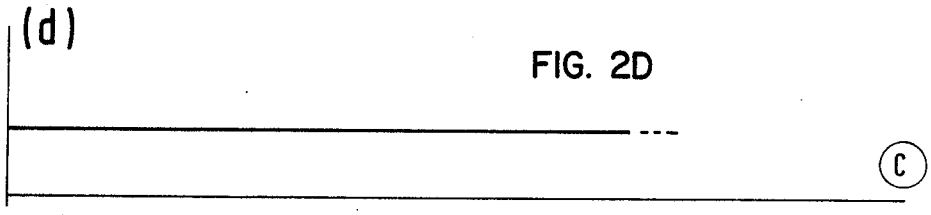
Figure 3A:
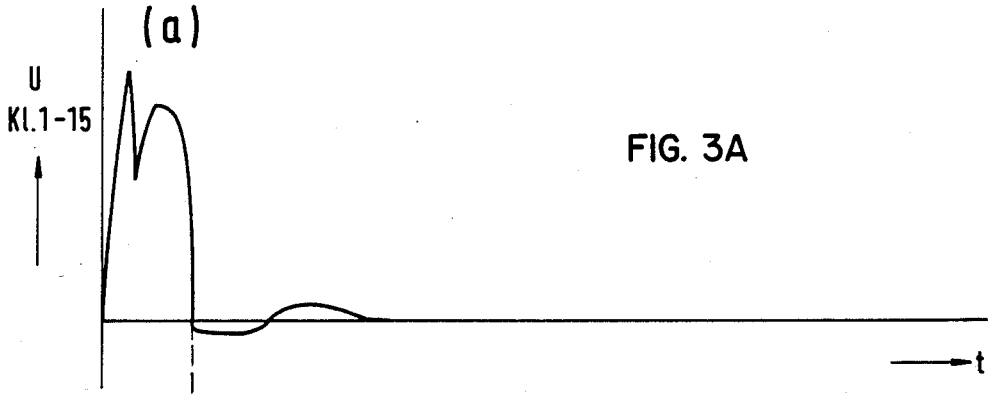
FIG. 3A–3D show the voltage versus time at various points in the circuit of FIG. 1 when the engine misfires.
Figure 3B:
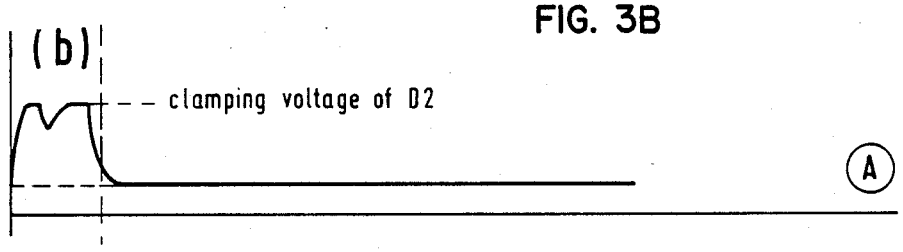
Figure 3C:
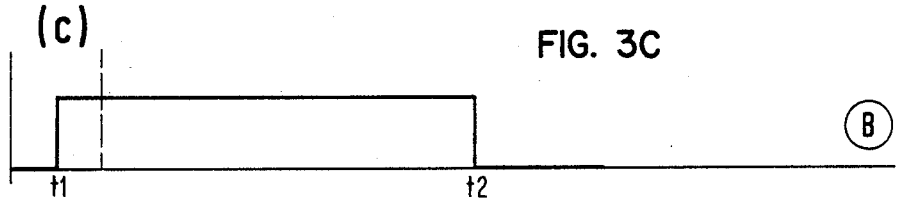
Figure 3D:
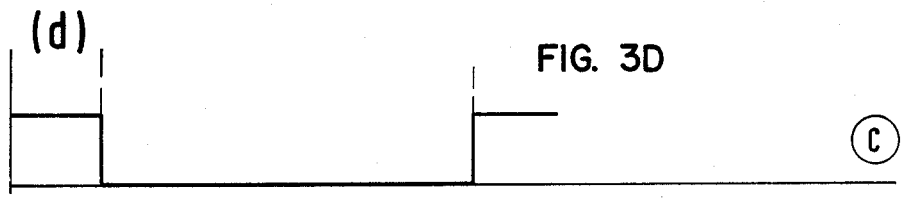

Referring firstly to FIG. 1, the circuit comprises a transistor T1 whose base is connected to the terminal Kl.15 of the ignition coil I via resistor R1 and diode D1. The collector of the transistor T1 is connected to ground via resistors R2 and R3. The emitter is connected to a terminal Kl.1. The terminals KL1 and KL15 are the primary terminals of the ignition coil with KL15 on the battery side such that the voltage at KL15 is the battery voltage supplied via the ignition lock. The junction between resistors R2 and R3 is connected to a first input of a comparator 10 via line L1. Signals supplied to the comparator 10 are smoothed by a capacitor C1 connected between L1 and ground and limited by a diode D2 connected between L1 and ground. Voltage pulses from source P to be described below are supplied to a second input of comparator 10 via a second line L2. A voltage divider formed by resistors R4 and R3 connected between a 5 volt supply bus and earth ensures that a certain minimum voltage is always supplied via line L1 to the first input of the comparator 10. In the illustrated embodiment R4 and R3 form a voltage divider with the ratio of R4 to R3 being about 10 so that a minimum of ½ volt is supplied to the first input of the comparator 10. The first input of the comparator mentioned above is preferably the non-inverting input and the second input is preferably the inverting input.

As mentioned above, misfiring can be detected by examining the shape of the voltage characteristic. The circuit shown in FIG. 1 is intended to examine the shape of the primary voltage characteristic. The voltages induced in the primary winding are then applied to the circuit of FIG. 1 across terminals Kl 1 and Kl 15. The transistor T1 together with components D1, R1, R2, R3 detects changes in the voltage induced in the primary and applies them to the comparator 10. The purpose of the components R2 and D2 is to protect the comparator 10.

OPERATION

Voltage changes detected by the transistor T1 are fed to the comparator 10 via resistors R2 and R3 which constitute a voltage divider. In the event of a spark, a voltage pulse is fed to the other input of the comparator 10. The comparator switches between two levels depending on which of its inputs is highest.

The voltage induced in the primary in response to spark production is hereinafter referred to as "the spark duration signal". FIG. 2, graph (a) shows a typical spark duration signal occurring during normal operation of the engine E. The primary voltage initially increases to a maximum, drops after spark firing at the spark plug to a value which is proportional to the so-called "spark burning voltage" and decays in a damped oscillation after breakdown of the ignition spark.

For normal operation of the engine the spark must be maintained for a predetermined length of time which is greater than or equal to a "minimum spark duration" between times t1 and t2, see FIG. 2, graph (c). If the spark breaks down too quickly, the result is misfiring.

FIG. 3, graph (a) illustrates the type of spark duration signal which occurs when there is no spark firing. The primary voltage decays immediately in a damped oscillation. The amplitude characteristic and frequency of the oscillation depend on the stored energy and also the values of R, L and C of the ignition circuit.

FIG. 2, graph (b) and FIG. 3, graph (b) each show the smoothed spark duration signal as applied to the input of comparator 10. The smoothed voltages decay to the 5 voltage level supplied via the voltage divider comprising resistors R4 and R3. The comparator, in this embodiment produces a HIGH output when the voltage at the non-inverting input is greater than the voltage at the inverting input. Thus when there is no voltage induced in the primary of the ignition coil and no voltage at the inverting input, the output of the comparator is at HIGH.

The voltage pulses supplied to the inverting input of the comparator are generated in response to the ignition instant P1. FIG. 2, graph (c) and FIG. 3, graph (c) each show one such pulse. Each pulse begins at a delay time t1 after the ignition instant. The magnitude of the pulses is selected such that during spark maintenance for normal ignition the output from the comparator is at a high level. This is illustrated in FIG. 2. graph (d) which shows the output from the comparator 10 during normal operation.

The predetermined duration t2-t1 of the pulses is selected to correspond to the minimum duration of spark burning voltage. Thus, if the spark is not maintained for the minimum spark duration the output from the comparator 10 will switch to a LOW level until the end of the generated pulse as illustrated in FIG. 3, graph (d). Thus LOW at the output from the comparator 10 indicates misfiring.

The reference voltage preferably has a predetermined magnitude and a predetermined duration and the detected and reference voltage are compared so as to detect when the magnitude of the detected voltage falls below the predetermined magnitude before the end of the duration.

In a microprocessor controlled ignition system, the pulses may be generated by the microcomputer; in a simple transistorised ignition system they may be generated by a monoflop stage or the like.

The detection of misfiring can be used in a number of ways. An optical or acoustic signal can be provided as a warning to the driver. The fuel injection to selected cylinders may be cut out in response to the LOW signal at the comparator. The LOW signal may also be used to switch over to an emergency running program to limit the catalyst temperature.

The circuit arrangement described above has a number of advantages including the following:

1. low hardware expenditure;
2. fast fault detection since the cause (misfiring) and not the effect (excessive catalyst temperature) is detected;
3. the system is suitable for vehicles with or without (excess air factor) control;
4. unlike the methods of the prior art, the fault detection is cYlinder-selective, allowing
   (a) cylinder-selective engine intervention, for example disconnection of the injection valve of a cylinder with defective ignition
   (b) diagnosis of the fault cause.

The application of a bias voltage to the comparator 10 ensures that the comparator 10 will to remain in a "high" state if no pulse is applied to the inverting output from pulse source P. The detection circuit, therefore, is disabled if there is no ignition initiated by the ignition control or engine control unit, that is, if no pulse corresponding to a minimum spark duration, is generated. Erroneous misfiring indication is thus prevented.

We claim:

1. A method of detecting misfiring in an internal combustion engine comprising
   detecting a signal indicative of the voltage in the primary winding of the ignition coil,
   generating, in response to ignition, a reference voltage pulse, representing normal firing, having a predetermined magnitude and a predetermined duration (t2-t1) corresponding to the period during which a minimum spark burning voltage is normally maintained and exceeding the period within which primary winding voltage decays in the absence of combustion, and
   comparing the detected voltage signal with the reference voltage to detect when the magnitude of the detected signal falls below said predetermined magnitude before the end of the predetermined duration thereby indicating misfiring in the engine.

2. A method as claimed in claim 1, in which the detected signal is derived from the primary winding of the ignition coil.

3. A method as claimed in claim 1, in which the primary voltage and the reference voltage are compared in a comparator (10).

4. A method as claimed in claim 1, including the step of generating a binary output voltage in dependence on the comparison of the detected voltage with the reference voltage.

5. A system for detecting misfiring in an internal combustion engine (E) comprising
   means (T1, D1 R1) coupled to an ignition coil (I) of the internal combustion engine (E) for deriving an ignition signal, smoothed by a capacitor, indicative of voltage in the primary winding of the ignition coil during an ignition or sparking event;
   means (P) for generating a reference signal, having a predetermined amplitude and predetermined duration, representative of normal firing of a spark plug, resulting in combustion in a cylinder of the engine; and
   comparator means (10), coupled to said ignition signal deriving means and to said reference signal generating means, for comparing the ignition signal and the reference signal and for delivering an output indicative of
   (1) normal firing, if said ignition signal maintains at least said reference signal predetermined amplitude for at least said reference signal predetermined duration; or
   (2) misfiring, if the magnitude of said ignition signal voltage falls below said predetermined amplitude before the end of said predetermined duration.

6. The system of claim 5, wherein said comparator means (10) provides a binary output indication of, respectively, normal firing or misfiring.

7. The system of claim 6, wherein said ignition signal deriving means includes means for introducing a bias voltage to said comparator means to ensure positive switching thereof between binary states.

8. The system of claim 6, wherein said ignition signal deriving means includes means for introducing a bias voltage to said comparator means (10) to ensure a first binary state of the comparator output if no reference signal is coupled to said comparator means to avoid erroneous indication of misfiring upon absence of reference signals.

9. The system of claim 5, wherein said means for generating the reference signal comprises a pulse generator generating a pulse having a predetermined magnitude and a predetermined duration;
   and wherein said comparator means compares said ignition signal with respect to said pulse and provides a "misfire" output signal if the magnitude of the derived ignition signal falls below said predetermined magnitude before the end of the predetermined duration.

10. The system of claim 9, wherein said comparator means provides a binary output signal and said "misfire"

signal comprises a change-of-state of said comparator means (10).

11. A system for detecting misfiring in an internal combustion engine (E) comprising transistor means (T1), having an emitter-collector path coupled to a firs terminal (1) of an ignition coil (I), for deriving an ignition signal indicative of voltage in the primary winding of the ignition coil during an ignition or sparking event;

resistor means (R1) and diode means (D1) coupled in series between a base of said transistor means and a voltage source;

means (P) for generating a reference signal representative of normal firing of a spark plug in a cylinder of the engine; and means (10) coupled to said ignition signal deriving means and to said reference signal generating means for comparing the ignition signal and the reference signal and for delivering an output indicative of (1) normal firing, if said signals have a predetermined relationship; or (2) misfiring, if said signals do not have said predetermined relationship.

12. A system according to claim 11, wherein said transistor means (T1) is so biased by said voltage source that it conducts only when said first terminal of said ignition coil is positive with respect to a second terminal (15) of said coil, and thereby suppresses application of signals to said comparator when said first terminal (1) is not positive with respect to said second terminal (15).

* * * * *